US007794164B2

(12) United States Patent
Kobayashi et al.

(10) Patent No.: US 7,794,164 B2
(45) Date of Patent: Sep. 14, 2010

(54) LAYERED GRIPPING MEMBER FOR A WRITING INSTRUMENT

(75) Inventors: Yoshihiro Kobayashi, Isesaki (JP); Akinori Ikeda, Tokyo-To (JP)

(73) Assignee: Kabushiki Kaisha Pilot Corporation, Tokyo-to (JP)

( * ) Notice: Subject to any disclaimer, the term of this patent is extended or adjusted under 35 U.S.C. 154(b) by 1272 days.

(21) Appl. No.: 10/562,150

(22) PCT Filed: Jun. 16, 2004

(86) PCT No.: PCT/JP2004/008448

§ 371 (c)(1),
(2), (4) Date: Dec. 23, 2005

(87) PCT Pub. No.: WO2005/000600

PCT Pub. Date: Jan. 6, 2005

(65) Prior Publication Data

US 2007/0020018 A1 Jan. 25, 2007

(30) Foreign Application Priority Data

Jun. 26, 2003 (JP) ..... 2003-182020

(51) Int. Cl.

| | |
|---|---|
| ***A45D 40/20*** | (2006.01) |
| ***A46B 5/02*** | (2006.01) |
| ***B43K 5/12*** | (2006.01) |
| ***B43K 7/06*** | (2006.01) |
| ***B43K 1/00*** | (2006.01) |

(52) U.S. Cl. ..... 401/88; 401/6; 401/192; 401/292

(58) Field of Classification Search ..... 401/6, 401/140, 192, 221, 292, 48, 88, 195, 208, 401/209

See application file for complete search history.

(56) References Cited

U.S. PATENT DOCUMENTS 3,250,033 A * 5/1966 Siegel ..... 40/334
4,819,939 A * 4/1989 Kobayashi ..... 473/299

(Continued)

FOREIGN PATENT DOCUMENTS

CN 2493421 5/2002

(Continued)

OTHER PUBLICATIONS

Chinese Office Action issued Jul. 4, 2008 in Chinese Application No. 200480024736.7.

(Continued)

*Primary Examiner*—Gregory L Huson
*Assistant Examiner*—Ryan A Varnum
(74) *Attorney, Agent, or Firm*—Wenderoth, Lind & Ponack, L.L.P.

(57) ABSTRACT

A barrel for a writing implement includes a barrel body having a gripping part, and a grip member of layered structure formed by assembling an inner member of a soft material and an outer member, and is put on the gripping part of the barrel body. The inner member is covered with the outer member, and at least one of the outside surface of the inner member and the inside surface of the outer member is formed in an assembly facilitating shape for facilitating putting the outer member on the inner member.

20 Claims, 5 Drawing Sheets

U.S. PATENT DOCUMENTS

| | | | | |
|---|---|---|---|---|
| 5,000,599 | A | 3/1991 | McCall et al. | |
| H1050 | H * | 5/1992 | Petrillo | 401/6 |
| 5,888,636 | A * | 3/1999 | Asanuma et al. | 428/213 |
| 6,447,190 | B1 * | 9/2002 | Kwitek | 401/6 |
| 6,652,941 | B1 * | 11/2003 | Chadwick et al. | 428/36.9 |

FOREIGN PATENT DOCUMENTS

| | | |
|---|---|---|
| JP | 58-175091 | 11/1983 |
| JP | 5-93882 | 12/1993 |
| JP | 55-110288 | 12/1993 |
| JP | 08-207485 | 8/1996 |
| JP | 2552183 | 7/1997 |
| JP | 11-216985 | 8/1999 |
| JP | 11-216985 A * | 8/1999 |
| JP | 2000-280681 | 10/2000 |
| JP | 2000-355185 | 12/2000 |
| JP | 2001-121876 | 5/2001 |
| JP | 2001-191681 | 7/2001 |
| JP | 3348180 | 9/2002 |
| JP | 2002-337495 | 11/2002 |
| JP | 2003-512960 | 4/2003 |
| JP | 2003-145983 | 5/2003 |
| WO | 01/32439 | 5/2001 |
| WO | 02/26555 | 4/2002 |

OTHER PUBLICATIONS

Supplementary European search report issued Mar. 4, 2009 in connection with European Patent Application No. 04 74 5989.

* cited by examiner

LAYERED GRIPPING MEMBER FOR A WRITING INSTRUMENT

TECHNICAL FIELD

The present invention relates to a barrel for a writing implement, having a grip part covered with a grip covering member. More specifically, the present invention relates to a barrel for a writing implement, provided with a grip covering member formed by assembling a soft inner member and an outer member.

BACKGROUND ART

A known barrel for a writing implement has a grip part covered with a grip covering member formed by assembling an inner member of a soft material and an outer member.

A writing implement having such a barrel is disclosed in JP 8-197883 A relating to "Grip Structure for Writing Implement and Coating Tool". This known writing implement is provided with a flexible, cylindrical grip member sealing therein a gas, a liquid, a gel or a jelly.

A grip for a writing implement is disclosed in JP 2000-355185 A relating to "Grip for Writing Implement". This known grip has an inner member having a Shore hardness between Hs5 and Hs30 (JIS A) and an outer member having a Shore hardness of Hs40 (JIS A) or above. A grip for a writing implement is disclosed in JP 09-169194 A relating to "Grip for Writing Implement". This known grip is formed by partially fusing together two types of resin members respectively having different hardnesses.

SUMMARY OF THE INVENTION

The flexible, cylindrical grip member sealing therein a gas, a liquid, a gel or a jelly disclosed in JP 8-197883 is difficult to fabricate and the gas, the liquid, the gel or the jelly sealed in the flexible, cylindrical grip and it is likely that the gas, the liquid, the gel or the jelly leaks out.

The inner and the outer member of the grip disclosed in JP 09-169194 are formed on a barrel by a dip coating method, a spray coating method or a two-color injection molding method. The boundary surfaces of the inner and the outer member are fused together or bonded together. Although dependent on surface roughness, it is very difficult to assemble the grip by covering the previously formed inner member with the outer member because the inner and the outer member made of soft materials need to slide relative to each other and against the frictional resistance which occurs in the relative sliding movement of the inner and the outer member made of soft materials.

Joining the inner and the outer member by fusion is difficult and costly, the grip thus fabricated is expensive and is not suitable for use on low-price products. It is likely that the respective hardnesses of the inner and the outer member changes when the inner and the outer member are joined together by fusion. When the outer member is transparent or semitransparent and the inner and outer member are colored in different colors, respectively, the colors of the inner and the outer member are mixed in the interface between the inner and the outer member and, consequently, the grip cannot be formed in a desired color.

Accordingly, it is an object of the present invention to provide a barrel for a writing implement, provided with a grip having an inner member and an outer member that can be easily assembled.

The present invention is capable solving the foregoing problem, and will be hereinafter described. The present invention will be described using the reference characters indicating the elements of the embodiments of the present invention to facilitate understanding the present invention. The present invention is not limited in its practical application to the preferred embodiments described herein.

The present invention provides a barrel (1, 11) for a writing implement formed by putting a grip member (G, G') of layered structure formed by assembling an inner member (4, 14) of a soft material and an outer member (5, 15) on a gripping part (3) of a barrel body (2). The inner member (4, 14) is covered with the outer member (5, 15). At least one of the outside surface (4*b*, 14*b*) of the inner member (4, 14) and the outside surface (5*b*, 15*b*) of the outer member (5, 15) is formed in an assembly facilitating shape (31, 41, 51) for facilitating putting the outer member on the inner member.

The assembly facilitating shape (31, 41, 51) may be a protruding and depressed shape.

The assembly facilitating shape may be a tapered shape.

The outer member (5, 15) may be put on the inner member (4, 14) so as to be separable from the inner member (4, 14) and the barrel body (2).

The outer member (5, 15) may be transparent or semitransparent and the inner member (4, 14) may be colored in a color different from that of the outer member (5, 15).

The inside surface of the outer member (5) may be glossy.

The inner member (4, 14) and the outer member (5, 15) may be made of materials of different hardnesses, respectively, the inner member (4, 14) may be made of a soft material having a low hardness, and the outer member (5, 15) may be made of a soft material having a high hardness.

The inside diameter of the outer member (5, 15) may be greater than the outside diameter of the inner member (4, 14), and the outer member (5, 15) may be axially compressed when put on the grip part (3) of the barrel body (2).

The outer member (15) may be provided with a radially inwardly extending protrusion (20) at the front end thereof and the back end surface (20*a*) of the protrusion (20) may be in contact with the front end surface (14*a*) of the inner member (14).

A part of the outer member (5, 15) corresponding to the inner member (4, 14) may have a mean wall thickness between 1 and 5 mm.

OPERATION OF THE INVENTION

The barrel (1, 11) for a writing implement is provided with the layered grip member (G, G') formed by assembling the inner member (4, 14) of a soft material and the outer member (5, 15) and put on the gripping part (3) of the barrel body (2). The inner member (4, 14) is covered with the outer member (5, 15). At least either of the outside surface (4*b*, 14*b*) of the inner member (4, 14) and the outside surface (5*b*, 15*b*) of the outer member (5, 15) is formed in the assembly facilitating shape (31, 41, 51) for facilitating putting the outer member on the inner member.

Therefore, in the barrel (1, 11) for a writing implement according to the present invention, the inner member (4, 14) can be easily covered with the outer member (5, 15), and hence the grip member (G, G') can be easily assembled.

When the assembly facilitating shape (31, 41, 51) is a protruding and depressed shape, resistance against the sliding movement of the outer member (5) along the inner member (4) is low and hence the outer member (5) can be easily put on the inner member (4). When the outer member (5) is deformed to bring the outer member (5) into close contact with the inner member (4), the protruding and depressed shape facilitates the flow of air into a space between the inner member (4) and the outer member (5). Consequently, outer member (5) in close contact with the inner member (4) can easily restore its original state.

When the assembly facilitating shape is a tapered shape, the outer member (5, 15) can be easily put on the inner member (4, 14).

When the outer member (5, 15) is detachably put on the inner member (4, 14) put on the barrel body (2) and is not bonded or fused to the inner member (4, 14), the outer member (5, 15) can be replaced with an outer member of a color and a hardness desired by the user.

When the outer member (5, 15) is transparent or semitransparent and the inner member (4, 14) is colored in a color different from that of the outer member (5, 15), characters and decorative patterns formed on the inner member (4, 14) can be visually recognized and can exercise a decorative effect.

When the inside surface of the outer member (5) is glossy, the inner member (4) and characters and decorative patterns formed on the inner member (4) can be easily seen through the outer member (5).

When the inner member (4, 14) and the outer member (5, 15) are made of materials of different hardnesses, respectively, the inner member (4, 14) is made of a soft material having a low hardness, and the outer member (5, 15) is made of a soft material having a high hardness, the outer member (5, 15) made of the soft material having a high hardness which is resistant to swelling due to aging, the possibility that the outer member (5, 15) comes off the inner member (4, 14) due to swelling can be reduced.

When the inside diameter of the outer member (5, 15) is greater than the outside diameter of the inner member (4, 14), and the outer member (5, 15) is axially compressed when put on the grip part (3) of the barrel body (2), the outer member (5, 15) having the inside diameter smaller than the outside diameter of the inner member (4, 14) can be easily put on the inner member (4, 14). Since the outer member (5, 15) is axially compressed when the outer member (5, 15) is put on the gripping part (3) of the barrel body (2), the outer member (5, 15) is difficult to be displaced when a force is exerted thereon when the writing implement is used for writing.

When the outer member (15) is provided with the radially inwardly extending protrusion (20) at the front end thereof and the back end surface (20*a*) of the protrusion (20) is in contact with the front end surface (14*a*) of the inner member (14), the front end of a large area of the outer member (15) is in contact with the front end of the inner member (14). Therefore, the outer member (15) is resistant to displacement and the radially inwardly extending protrusion exercises an improved effect on preventing the displacement of the outer member (15).

Forming the part of the outer member (5, 15) corresponding to the inner member (4, 14) in a mean wall thickness between 1 and 5 mm is more effective in suppressing the deformation of the outer member (5, 15) than forming the outer member (5, 15) in a wall thickness below 1 mm, facilitates putting the outer member (5, 15) on the inner member (4, 14) and makes the outer member (5, 15) to restore its original state after the outer member (5, 15) is deformed and brought into close contact with the inner member (4, 14). Forming the part of the outer member (5, 15) corresponding to the inner member (4, 14) in a mean wall thickness between 1 and 5 mm is more effective in making the hardness and the color of the inner member (4, 14) effective than forming the outer member (5, 15) in a wall thickness above 5 mm.

The soft material may be chosen from generally known elastic materials for forming the grip members (G, G') of writing implements including elastically deformable silicone rubber, natural rubber, isobutylene-isoprene rubber, fluorocarbon rubber, vinyl chloride resins, butadiene rubber, urethane rubber, polyethylene resins, synthetic rubbers and thermoplastic elastomers. The soft materials respectively having different hardnesses may be one and the same soft materials or different soft materials.

EFFECT OF THE INVENTION

The present invention provides the barrel for a writing implement, provided with the layered grip member that can be formed by easily assembling the inner member and the outer member.

DETAILED DESCRIPTION OF THE INVENTION

Figure 1:
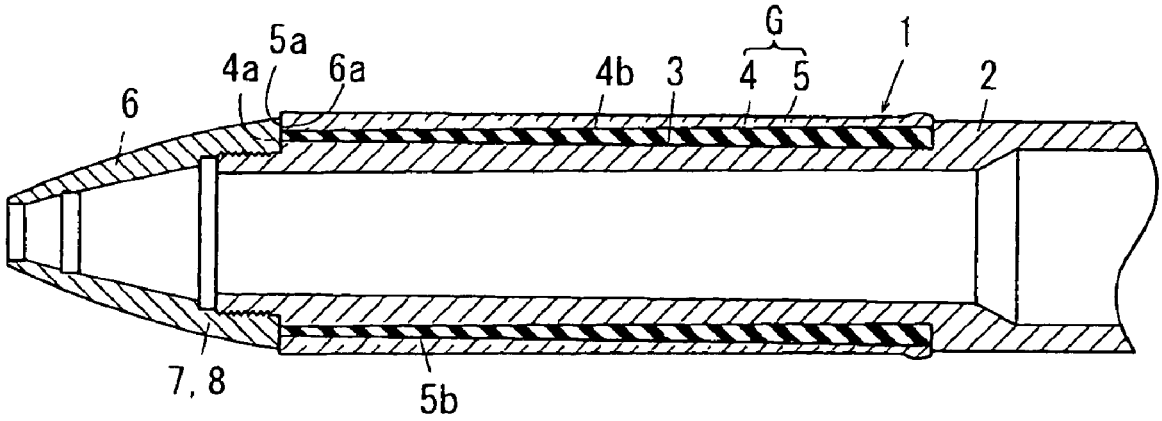
FIG. 1 is a fragmentally longitudinal sectional view of a barrel in a first embodiment according to the present invention.

Preferred embodiments of the present invention will be described with reference to the accompanying drawings, in which like or corresponding members and the same parts are designated by the same reference characters.

First Embodiment

Figure 2:
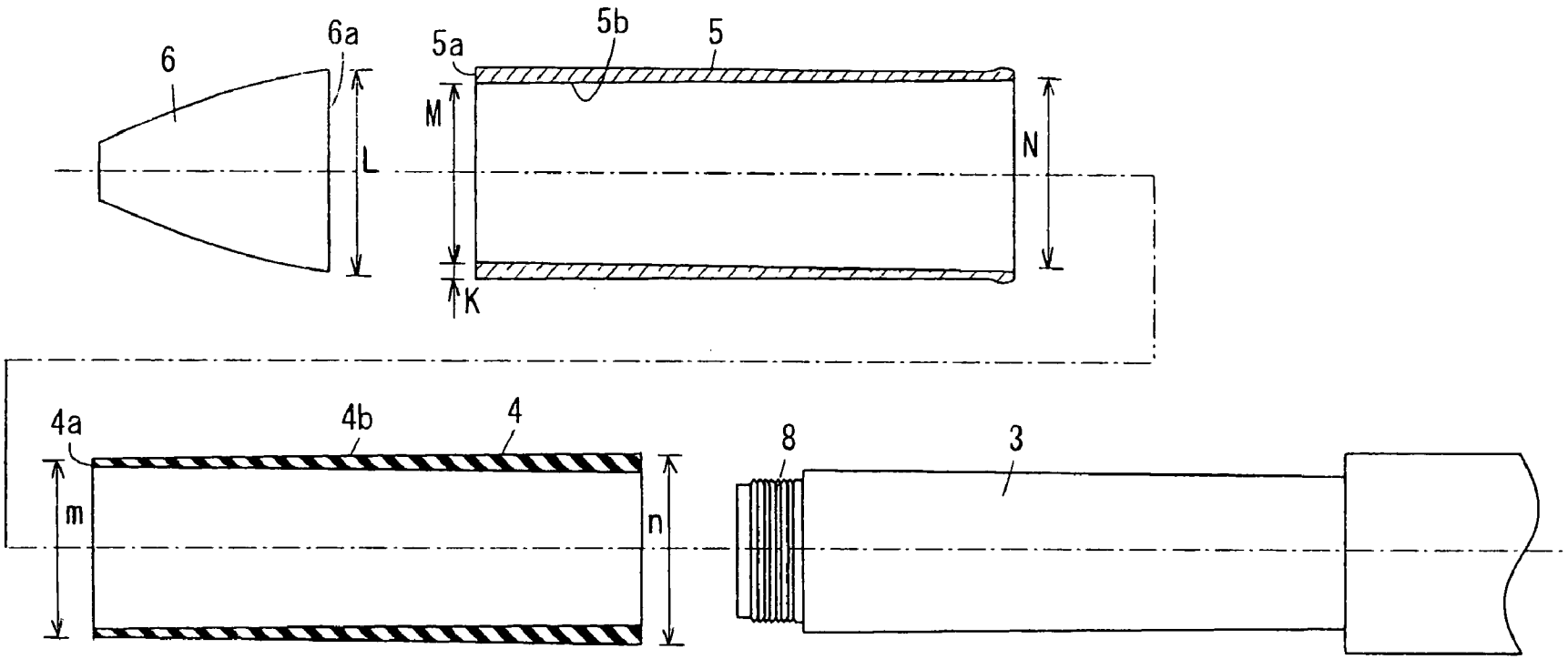
FIG. 2 is a sectional view of an essential part of the barrel shown in FIG. 1 for assistance in explaining an assembling procedure.

Referring to FIGS. 1 and 2, a barrel 1 in a first embodiment according to the present invention has a barrel body 2 made of an acrylonitrile-styrene resin (AS resin). The barrel body 2 has a gripping part 3 of a reduced outside diameter. A grip member G is put on the gripping part 3. The grip member G includes a blue inner member 4 made of silicone rubber having a Shore hardness of Hs30 (JIS A) and a transparent outer member 5 made of silicone rubber having a Shore hardness of Hs70 (JIS A). The inner member 4 is put on the gripping part 3 of the barrel body 2, and then the outer member 5 is put on the inner member 4 so as to cover the inner member 4. A barrel cap 6 having an internally threaded part 7 is attached to the barrel body having an externally threaded part 8 by screwing the internally threaded part 7 on the externally threaded part 8 of the barrel body 2 so that the back end surface 6*a* of the barrel cap 6 is pressed against the front end surface 4*a* of the inner member 4 and the front end surface 5*a* of the outer member 5 to compress the inner member 4 and the outer member 5 to complete the barrel 1 for the writing implement. For example, a ball pen refill having a ball-point tip is inserted in the barrel to form a writing implement.

Fine protrusions and depressions (assembly facilitating shapes) are formed in the outside surface 4*b* of the inner member 4 and the inside surface 5*b* of the outer member 5. The protrusions and depressions reduce resistance against the sliding movement of the inside surface 5*b* of the outer member 5 along the outside surface 4*b* of the inner member 4 when the outer member 5 is put on the inner member 4 to facilitate assembling the inner member 4 and the outer member 5. Even if the outer member 5 is deformed and the inside surface 5*b* of the outer member 5 is brought into close contact with the outside surface 4*b* of the inner member 4 by pressure exerted on the outer member 5 when the writing implement is used for writing, the outer member 5 can easily restore its original state because the outer member 5 is made of the elastically deformable, soft material and the protrusions and depressions facilitate the flow of air into the gap between the inner member 4 and the outer member 5. Although there are not any restrictions on a method of forming the protrusions and depressions and the shapes of the protrusions and depressions, it is preferable that fine protrusions and fine depressions are formed in the outside surface 4*b* of the inner member 4 and the inside surface 5*b* of the outer member 5 by, for example, satin finish.

The outer member 5 can be easily put on the inner member 4 by forming the outside surface 4*b* of the inner member 4 and the inside surface 5*b* of the outer member 5 in tapered surfaces tapering toward the front ends, respectively (assembly facilitating shapes). As seen in FIGS. 1 and 2, the front end of the outer member has a greater wall thickness than the back end thereof, such that the outer member tapers from front to back. When the outside surface 4*b* of the inner member 4 and the inside surface 5*b* of the outer member 5 are thus tapered, the outside diameters of the front and the back end of the inner member 4 are m and n, where m<n, and the inside diameters of the front and the back end of the outer member 5 are M and N, where M<N.

The soft materials forming the grip member G absorb moisture and oil considerably and swell and the outside diameter of the inner member 4 and the inside diameter of the outer member 5 increase with time. Consequently, the grip member G tends to move axially when the grip member G is pushed forward by force when the writing implement is used for writing and, when things come to the worst, the outer member 5 comes off the barrel body 2. It is possible to make the outer member 5 difficult to be displaced even if force acts on a front part of the barrel 1 when the writing implement is used for writing by forming the outside surface 4*b* of the inner member 4 and the inside surface 5*b* of the outer member 5 in tapered surfaces tapering toward the front and increasing the wall thickness K of a front part contiguous with the front end 5*a* of the outer member 5 in contact with the barrel cap 6.

The outer member 5 can be easily put on the inner member 4 and the outer member 5 has difficulty in coming in close contact with the inner member 4 if the inner member 4 and the outer member 5 are formed such that m<M and n<N, where m and n are the outside diameters of the front and the back end of the inner member 4, and M and N are the inside diameters of the front and the back end of the outer member 5. In view of dimensional accuracy dependent on forming conditions, it is desirable that the inside diameter of a part of the outer member 5 is greater than the outside diameter of a part of the inner member 4 corresponding to the part of the outer member 5 by about 0.05 mm.

Second Embodiment

Figure 3:
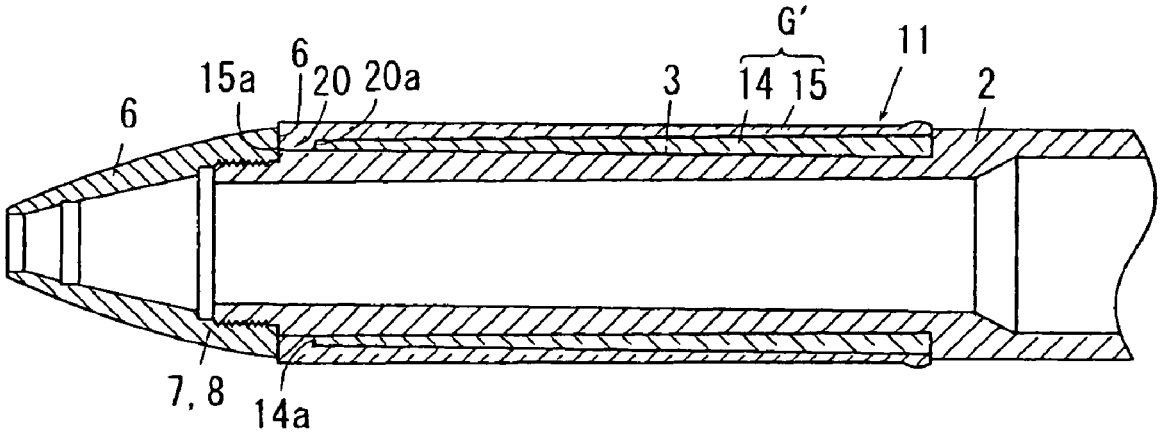
FIG. 3 is a fragmentally longitudinal sectional view of a barrel in a second embodiment according to the present invention.
Figure 4:
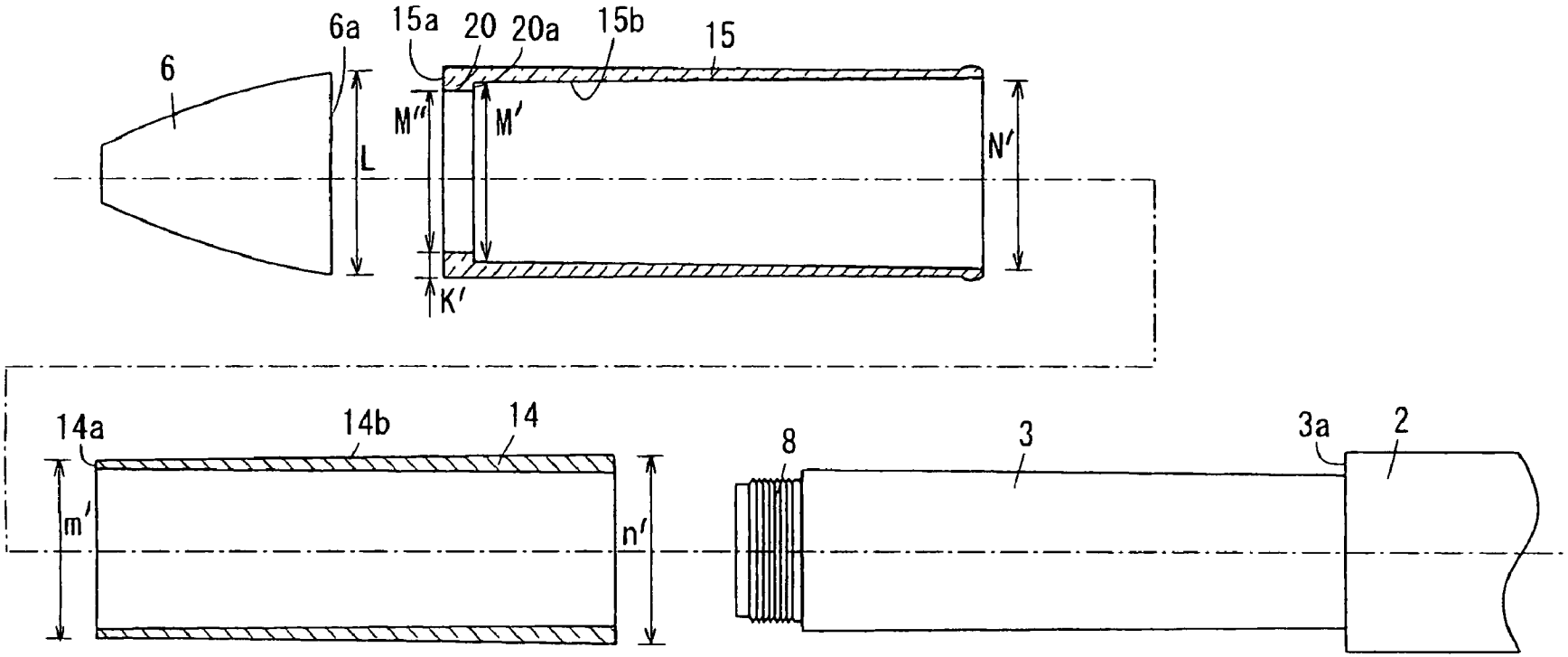
FIG. 4 is a sectional view of an essential part of the barrel shown in FIG. 3 for assistance in explaining an assembling procedure.

A barrel 11 in a second embodiment according to the present invention for a writing implement shown in FIGS. 3 and 4 is substantially the same as the barrel 1 in the first embodiment, except that the barrel 11 in the second embodiment has a grip member G' put on a gripping part 3 of a barrel body 2 and including a semitransparent outer member 15 having a Shore hardness of Hs70 (JIS A) provided with an annular protrusion 20 formed in a front end part thereof so as to protrude radially inward and a transparent inner member 14 having a Shore hardness of Hs50 (JIS A) coated with the outer member 15 with its front end surface 14*a* in contact with the back end surface 20*a* of the annular protrusion 20.

Since the front end surface 14*a* of the inner member 14 is in contact with the back end surface 20*a* of the radially inwardly protruding annular protrusion 20 of the outer member 15 in an increased contact area, the displacement of the outer member 15 can be effectively prevented by an increased resistance. Since the front end part of the outer member 15 provided with the annular protrusion 20 has an increased wall thickness K', the inside diameter M' of the front end of the outer layer 15 will hardly become greater than the outside diameter of the back end of a barrel cap 6 even if the inner member 14 and the outer layer 15 swell with time and hence the outer member 15 will not be displaced.

The outside surface 14*b* of the inner member 14 and the inside surface 15*b* of the outer member 15, similarly to those of the barrel 1 in the first embodiment, are tapered toward the front (formed in assembly facilitating shapes) such that the outside diameters of the front and the back end of the inner member 14 are m' and n', and the inside diameters of the front and the back end of the outer member 15 are M' and N', where m'<M', n'<N'. Thus the outer member 15 can be easily put on the inner member 14. As seen in FIGS. 3 and 4, the front end of the outer member has a greater wall thickness than the back end thereof, such that the outer member tapers from the annular protrusion 20 to the back end.

Third Embodiment

A barrel 1 in a third embodiment according to the present invention will be described, in which parts like or corresponding to those of the barrel 1 in the first embodiment are denoted by the same reference characters and the description thereof will be omitted.

The barrel 1 in the third embodiment is the same as the barrel 1 in the first embodiment and differs from the latter only in the following respects.

Figure 5:
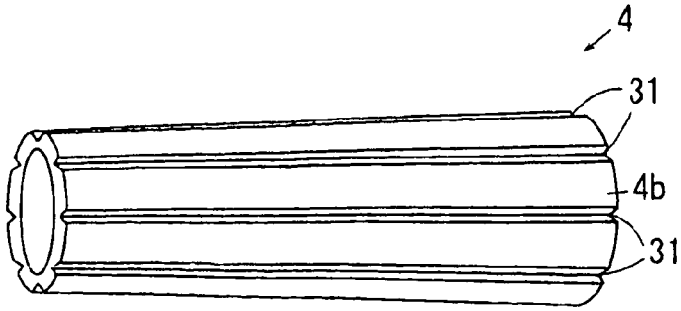
FIG. 5 is a perspective view of an inner member included in a barrel in a third embodiment according to the present invention.

Referring to FIG. 5 showing an inner member 4 of the barrel in the third embodiment for a writing implement in a perspective view, the inner member 4 has an outside surface 4*b* provided with a plurality of axial grooves (assembly facilitating shapes) 31. When an outer member 5 is put on the inner member 4 so as to cover the inner member 4, the grooves 31 reduces the area of contact between the inner member 4 and the outer member 5. Consequently, frictional resistance against the movement of the outer member 5 relative to the inner member 4 when the outer member 5 is put on the inner member 4 is reduced and hence the outer member 5 can be easily put on the inner member 4. Even if the inside surface 5*b* of the outer member 5 is brought into close contact with the outside surface 4*b* of the inner member 4 by pressure applied to the outer member 5 when the writing implement is used for writing, the outer member 5 in close contact with the inner member 4 can easily restore its original shape because air can easily flow into the gap between the inner member 4 and the outer member 5. Axial grooves may be formed in the inside surface 5*b* of the outer member 5 instead of in the outside surface 4*b* of the inner member 4 or may be formed in both the outside surface 4*b* of the inner member 4 and the inside surface 5*b* of the outer member 5.

Fourth Embodiment

A barrel 1 in a fourth embodiment according to the present invention will be described, in which parts like or corresponding to those of the barrel 1 in the third embodiment are denoted by the same reference characters and the description thereof will be omitted.

The barrel 1 in the fourth embodiment is the same as the barrel 1 in the third embodiment and differs from the latter only in the following respects.

Figure 6:
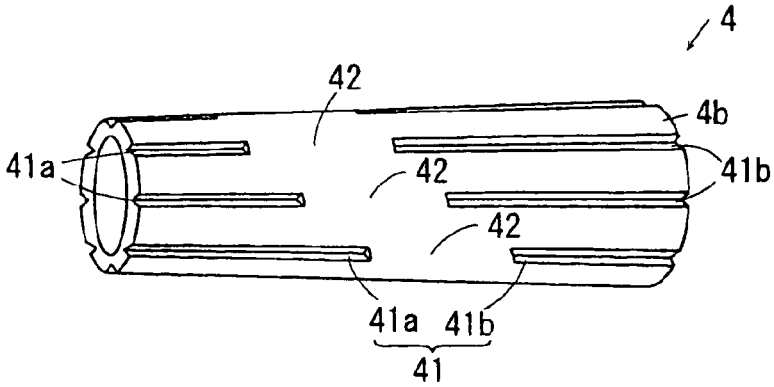
FIG. 6 is a perspective view of an inner member included in a barrel in a fourth embodiment according to the present invention.

Referring to FIG. 6 showing an inner member 4 of the barrel 1 in the fourth embodiment for a writing implement in a perspective view, the inner member 4 has an outside surface 4*b* provided with a plurality of axial grooves (assembly facilitating shapes) 41. Each of the axial grooves 41 is divided into a front groove 41*a* and a back groove 41*b*, which are separated by a spacing area 42. As shown in FIG. 6, the spacing areas 42 are formed in a circumferential arrangement at different axial positions, respectively. Thus an outer member 5 of the barrel 1 in the fourth embodiment, similarly to that of the barrel 1 in the third embodiment, can be easily put on the inner member 4. The positions and sizes of the front grooves 41*a*, the back grooves 41*b* and the spacing areas 42 may be optionally determined according to a desired design.

Fifth Embodiment

A barrel 1 in a fifth embodiment according to the present invention will be described, in which parts like or corresponding to those of the barrel 1 in the first embodiment are denoted by the same reference characters and the description thereof will be omitted.

The barrel 1 in the fifth embodiment is the same as the barrel 1 in the first embodiment and differs from the latter only in the following respects.

Figure 7:
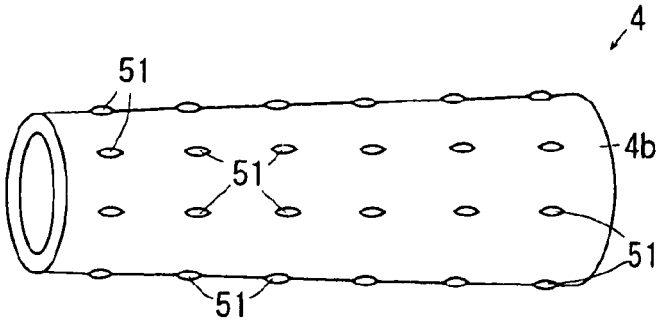
FIG. 7 is a perspective view of an inner member included in a barrel in a fifth embodiment according to the present invention.

Referring to FIG. 7 showing an inner member 4 of the barrel 1 in the fifth embodiment for a writing implement in a perspective view, the inner member 4 has an outside surface 4*b* provided with a plurality of semispherical protrusions (assembly facilitating shapes) 51. Thus an outer member 5 of the barrel 1 in the fifth embodiment, similarly to that of the barrel 1 in the first embodiment, can be easily put on the inner member 4 because resistance against the movement of the outer member 5 relative to the inner member 4 is low.

Sixth Embodiment

A barrel 1 in a sixth embodiment according to the present invention will be described, in which parts like or corresponding to those of the barrel 1 in the first embodiment are denoted by the same reference characters and the description thereof will be omitted.

The barrel 1 in the fifth embodiment is the same as the barrel 1 in the first embodiment and differs from the latter only in the following respects.

Figure 8:
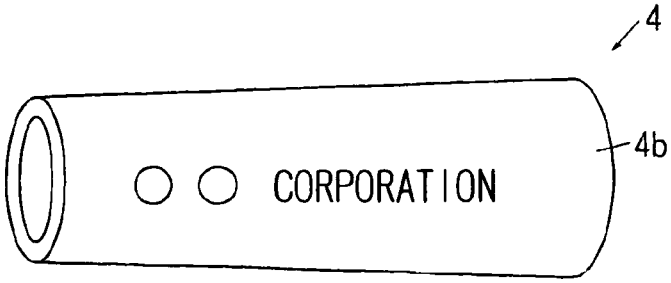
FIG. 8 is a perspective view of an inner member included in a barrel in a sixth embodiment according to the present invention.

Referring to FIG. 8 showing an inner member 4 of the barrel 1 in the sixth embodiment for a writing implement in a perspective view, the inner member 4 has a satin finished outside surface 4*b* provided, similarly to that of the barrel 1 in the first embodiment, with fine protrusions and fine depressions (assembly facilitating shapes). Characters indicating a customer's name are printed on the outside surface 4*b*. The inner member 4 is covered with a transparent outer member 5. Thus user is can visually recognize the customer's name through the outer member 5. It is likely that a name printed on the gripping part 3 of the barrel body 2 is difficult to recognize visually when the grip member G has a big wall thickness. In the barrel 1 in the sixth embodiment, the customer's name is printed on the outside surface of the inner member 4 and hence the customer's name can be easily visually recognized when the outer member 5 is not excessively thick.

Characters to be printed on the outside surface 4*b* of the inner member 4 are not limited to those indicating the customer's name, but may be characters indicating a trade name, or a maker's name, a design or a decorative pattern. The outer member 5 may be semitransparent. The inner member 4 may be semitransparent or transparent. The inner member 4 and the characters printed on the inner member 4 can be easily recognized when the inside surface of the outer member 5 is glossy and the outside surface of the inner member 4 is satin-finished.

Modifications

Although the present invention has been described in its preferred embodiments, changes and variations are possible thereof without departing from the scope of the present invention. Possible modifications will be described below.

Although the grip member of the present invention may be any color, it is preferable to form the inner and the outer member in different colors, respectively, for an improved decorative effect.

Although the inner and the outer member may be formed in any suitable hardnesses, respectively, it is desirable to make the inner member of a soft material having a low hardness because soft materials having a Shore hardness of Hs40 or below are likely to swell with time.

In each of the foregoing embodiments, the inner and the outer members are formed separately, the inner member is put on the gripping part of the barrel body, and then the outer member is put on the inner member. The inner and the outer member may be integrally formed by a two-color injection molding method. Another member may be disposed on the gripping part so as to underlie the inner member.

According to the present invention, the inner member is covered with the outer member. The outer member may be put on the inner member put on the barrel body or the grip member formed by assembling the inner and the outer member may be put on the barrel body, provided that the corresponding surfaces of the inner and the outer member are not fused or bonded together and the inner member is covered with the outer member. The inner and the outer member may be fused or bonded together so that the outside surface of the inner member and the inside surface of the outer member may not be affected after covering the inner member with the outer member. However, it is preferable to put the outer member detachably on the inner member to enable the replacement of the outer member with another outer member of a color and a soft material having a hardness desired by the user.

Although there are not any particular restrictions on the respective wall thicknesses of the inner and the outer member, the outer member deforms easily, is difficult to put on the inner member and cannot easily restore its original state when the outer member is brought into close contact with the inner member if the wall thickness of the outer member is below 1 mm. Preferably, the mean wall thickness of the outer member is between 1 and 5 mm because the effects of the inner member including the hardness and the color become ineffective when the wall thickness of the outer member is greater than 5 mm. The man wall thickness of the outer member is the mean of wall thicknesses of parts of the outer member corresponding to the inner member.

The axial grooves 31 and 41 of the barrels in the third and the fourth embodiment may be replaced with axial ridges rising from the outside surfaces 4*b*.

Each of the grip members G and G' of the barrels in the first and the second embodiment is provided with two types of assembly facilitating shapes, namely, the tapered surface, and the protrusions and depressions. Each of the grip members G and G' may be provided with only either of the two types of assembly facilitating shapes.

The invention claimed is:

1. A barrel for a writing implement, the barrel comprising:

a barrel body having a gripping part, the gripping part having a front end and a back end; and a grip member of layered structure formed by assembling an inner member and an outer member, the grip member being disposed on the gripping part of the barrel body, wherein the inner member is covered with the outer member, and the grip member is formed in an assembly facilitating shape for facilitating putting the outer member on the inner member, wherein each of the inner member and the outer member is formed prior to putting the outer member on the inner member such that each of the inner member and the outer member constitutes a preformed member, wherein the inner member has a first distal end disposed at the front end of the gripping part and a second distal end disposed at the back end of the gripping part, wherein the outer member has a first distal end disposed at the front end of the gripping part and a second distal end disposed at the back end of the gripping part, wherein the assembly facilitating shape is a tapered configuration, the outer member tapering from a location adjacent to the first distal end to the second distal end thereof, and the inner member tapering from the second distal end thereof to the first distal end thereof, and wherein the outer member is configured to be axially compressed when put on the grip part of the barrel body.

2. The barrel for a writing implement according to claim 1, wherein each of the outer member and the inner member are formed such that, before putting the outer member onto the inner member, the outer member has an inside diameter greater than an outside diameter of the inner member, and wherein the outer member is put on the inner member so as to be separable from the inner member and the barrel body.

3. The barrel for a writing implement according to claim 1, wherein the outer member is transparent or semitransparent and the inner member is colored in a color different from that of the outer member.

4. The barrel for a writing implement according to claim 3, wherein the inside surface of the outer member is glossy.

5. The barrel for a writing implement according to claim 1, wherein the inner member and the outer member are made of materials of different hardnesses, the inner member being made of a soft material having a low hardness, and the outer member being made of a soft material having a high hardness.

6. The barrel for a writing implement according to claim 1, wherein the first distal end of the outer member is provided with a radially inwardly extending protrusion, the radially inwardly extending protrusion having a bottom surface and a back surface, and wherein the bottom surface of the radially inwardly extending protrusion contacts the barrel body and the back surface of the radially inwardly extending protrusion contacts the inner member, and wherein the outer member tapers from the radially inwardly extending protrusion to the second distal end of the outer member.

7. The barrel for a writing implement according to claim 1, wherein a length of the outer member extending from the location adjacent to the first distal end to the second distal end has a mean wall thickness between 1 and 5 mm.

8. The barrel for a writing implement according to claim 2, wherein the outer member is transparent or semitransparent and the inner member is colored in a color different from that of the outer member.

9. The barrel for a writing implement according to claim 2, wherein the inner member and the outer member are made of materials of different hardnesses, the inner member being made of a soft material having a low hardness, and the outer member being made of a soft material having a high hardness.

10. The barrel for a writing implement according to claim 3, wherein the inner member and the outer member are made of materials of different hardnesses, the inner member being made of a soft material having a low hardness, and the outer member being made of a soft material having a high hardness.

11. The barrel for a writing implement according to claim 4, wherein the inner member and the outer member are made of materials of different hardnesses, the inner member being made of a soft material having a low hardness, and the outer member being made of a soft material having a high hardness.

12. The barrel for a writing implement according to claim 1, wherein the outer member tapers from the first distal end to the second distal end, and wherein the first distal end of the outer member circumscribes the first distal end of the inner member and the second distal end of the outer member circumscribes the second distal end of the inner member such that the inner member and the outer member are coextensive over the barrel body and are tapered in opposite directions.

13. A barrel for a writing implement according to claim 1, wherein the barrel body further includes a threaded portion, the threaded portion being provided for connecting to a barrel cap, and wherein the threaded portion is disposed in a position relative to said grip member such that the outer member of the grip member is axially compressed by the barrel cap when the barrel cap is connected to the threaded portion.

14. A barrel for a writing implement, the barrel comprising:

a barrel body having a gripping part, the gripping part having a front end and a back end; and a grip member of layered structure formed by assembling an inner member and an outer member, the grip member being disposed on the gripping part of the barrel body such that the inner member contacts the gripping part of the barrel body, wherein the inner member is covered with the outer member, and the grip member is formed in an assembly facilitating shape for facilitating putting the outer member on the inner member, wherein each of the inner member and the outer member is formed prior to putting the outer member on the inner member such that each of the inner member and the outer member constitutes a preformed member, wherein the inner member has a first distal end disposed at the front end of the gripping part and a second distal end disposed at the back end of the gripping part, the inner member being formed with an outside diameter m at the first distal end thereof and an outside diameter n at the second distal end thereof, wherein the outer member has a first distal end disposed at the front end of the gripping part and a second distal end disposed at the back end of the gripping part, the outer member being formed with an inside diameter M at the first distal end thereof and an inside diameter N at the second distal end thereof, wherein the assembly facilitating shape is a tapered configuration, the outer member tapering from the first distal end thereof to the second distal end thereof such that M<N, and the inner member tapering from the second distal end thereof to the first distal end thereof such that m<n, and wherein the outer member is configured to be axially compressed when put on the grip part of the barrel body.

15. The barrel for a writing implement according to claim 14, wherein each of the outer member and the inner member are formed such that, before putting the outer member onto the inner member, m<M and n<N, and wherein the outer member is put on the inner member so as to be separable from the inner member and the barrel body.

16. The barrel for a writing implement according to claim 14, wherein the outer member is transparent or semitransparent and the inner member is colored in a color different from that of the outer member.

17. The barrel for a writing implement according to claim 14, wherein the inner member and the outer member are made of materials of different hardnesses, the inner member being made of a soft material having a low hardness, and the outer member being made of a soft material having a high hardness.

18. The barrel for a writing implement according to claim 14, wherein the outer member corresponding to the inner member has a mean wall thickness between 1 and 5 mm.

19. The barrel for a writing implement according to claim 14, wherein the first distal end of the outer member circumscribes the first distal end of the inner member and the second distal end of the outer member circumscribes the second distal end of the inner member such that the inner member and the outer member are coextensive over the barrel body and are tapered in opposite directions.

20. A barrel for a writing implement according to claim 14, wherein the barrel body further includes a threaded portion, the threaded portion being provided for connecting to a barrel cap, and wherein the threaded portion is disposed in a position relative to said grip member such that the outer member of the grip member is axially compressed by the barrel cap when the barrel cap is connected to the threaded portion.

* * * * *